US006988742B2

(12) United States Patent
Jonsson et al.

(10) Patent No.: US 6,988,742 B2
(45) Date of Patent: Jan. 24, 2006

(54) ROLLER SKI WITH ELECTRICALLY ACTIVATED BREAKING MECHANISM

(75) Inventors: Niclas Jonsson, Pitea (SE); Magnus Ingesson, Pitea (SE); Peter Stenlund, Pitea (SE); Roland Ohrvall, Ojebyn (SE)

(73) Assignee: RO Rollytech AB, (SE)

( * ) Notice: Subject to any disclaimer, the term of this patent is extended or adjusted under 35 U.S.C. 154(b) by 0 days.

(21) Appl. No.: 10/468,567

(22) PCT Filed: Feb. 21, 2002

(86) PCT No.: PCT/SE02/00305

§ 371 (c)(1),
(2), (4) Date: Jan. 12, 2004

(87) PCT Pub. No.: WO02/066123

PCT Pub. Date: Aug. 29, 2002

(65) Prior Publication Data

US 2004/0113415 A1 Jun. 17, 2004

(30) Foreign Application Priority Data

Feb. 22, 2001 (SE) ..... 0100608

(51) Int. Cl.

| | |
|---|---|
| ***B62B 1/00*** | (2006.01) |
| ***B62B 17/08*** | (2006.01) |
| ***A63C 17/14*** | (2006.01) |
| ***A63C 5/00*** | (2006.01) |
| ***B62M 1/00*** | (2006.01) |

(52) U.S. Cl. ..... 280/642; 280/11.211; 280/87.042; 280/604; 188/8; 188/161

(58) Field of Classification Search ..... 280/842, 280/11.211, 11.212, 11.213, 87.042, 87.041, 280/87.01, 604, 605; 188/8, 161
See application file for complete search history.

(56) References Cited

U.S. PATENT DOCUMENTS

| | | | | |
|---|---|---|---|---|
| 3,652,103 | A * | 3/1972 | Higgs | 280/33.994 |
| 4,021,052 | A * | 5/1977 | Knowles | 280/842 |
| 4,050,705 | A * | 9/1977 | Kreis | 280/842 |
| 4,069,881 | A * | 1/1978 | Shiber | 180/181 |
| 4,092,033 | A * | 5/1978 | Swain | 280/87.042 |
| 4,166,519 | A * | 9/1979 | Maloney | 188/29 |
| 4,168,076 | A * | 9/1979 | Johnson | 280/11.216 |

(Continued)

FOREIGN PATENT DOCUMENTS

| | | | | |
|---|---|---|---|---|
| DE | 3424564 A1 * | 1/1986 | | 280/87.042 |

(Continued)

OTHER PUBLICATIONS

English language translation of DE 4424372 A1; translated by FLS, Inc.; translated Feb. 2005.*

*Primary Examiner*—J. Allen Shriver
*Assistant Examiner*—G B Klebe
(74) *Attorney, Agent, or Firm*—Ostrolenk, Faber, Gerb & Soffen, LLP

(57) ABSTRACT

The invention relates to a roller ski comprising a ski body (1) having a front and a rear end. A wheel (2) is arranged at each end. The invention aims at providing a roller ski that resembles skiing on snow. In accordance with the invention the roller ski is provided with a wheel brake and a brake activator, which brake activator is arranged the wheel brake when a certain downward flexing of the ski is exceeded. The brake activator comprises electric brake activating means.

12 Claims, 3 Drawing Sheets

U.S. PATENT DOCUMENTS

| | | | | | |
|---|---|---|---|---|---|
| 4,190,261 | A | * | 2/1980 | Moutz | 280/87.01 |
| 4,892,332 | A | * | 1/1990 | Jennings | 280/842 |
| 5,020,621 | A | * | 6/1991 | Martin | 180/181 |
| 5,280,930 | A | * | 1/1994 | Smathers et al. | 280/11.212 |
| 5,673,941 | A | | 10/1997 | Osawa | |
| 5,819,865 | A | * | 10/1998 | Cowley | 280/93.502 |
| 5,893,425 | A | * | 4/1999 | Finkle | 180/181 |
| 5,915,707 | A | * | 6/1999 | Steffen | 280/87.03 |
| 5,934,691 | A | * | 8/1999 | Stivali | 280/11.212 |
| 5,947,495 | A | * | 9/1999 | Null et al. | 280/87.042 |
| 6,050,357 | A | * | 4/2000 | Staelin et al. | 180/65.1 |
| 6,698,776 | B2 | * | 3/2004 | Todd | 280/87.042 |

FOREIGN PATENT DOCUMENTS

| | | | | |
|---|---|---|---|---|
| DE | 4 424 372 | | 1/1996 | |
| DE | 2 992 2 386 | | 5/2000 | |
| DE | 1 992 8 634 | | 12/2000 | |
| FR | 2641702 | * | 7/1990 | 280/87.042 |

* cited by examiner

ROLLER SKI WITH ELECTRICALLY ACTIVATED BREAKING MECHANISM

TECHNICAL FIELD

The present invention relates to a roller ski having a front and a rear end and a wheel arranged at each end.

BACKGROUND ART

It is previously known to provide a roller ski with wheel brakes. The construction is normally such that the wheel provided with a brake cannot rotate backwards. This simulates skiing on snow to a certain extent, but not entirely.

The object of the present invention, therefore, is to provide a roller ski that more completely resembles skiing on snow, in a simple and reliable manner.

DESCRIPTION OF THE INVENTION

This object is achieved in accordance with the invention by a roller ski of the type described herein being provided with the special feature of the brake activator comprising electric brake activating means.

A wheel brake in which the brake is activated by downward flexing gives a more realistic simulation of skiing on snow. This is because a relatively great downward flexing is the result of a strong depression on the ski. This is the type of depression in normal skiing that achieves grip since the span of the ski is completely or partially overcome by the depression so that the middle of the ski where the gripping wax is normally applied will come into contact with the snow and provide grip. A braking device resembles this method of achieving grip. Since the brake is activated as soon as the ski is depressed, an immediate response is also obtained so that the braking effect can occur earlier than with conventional a ski brake. The latter is only activated when the roller ski starts to move backwards.

Since the brake activating means is electric the device is extremely simple and reliable and enables braking to be effected by simple means converting depression to braking. The absence of mechanical elements also means there is less risk of faults.

In accordance with a preferred embodiment the wheel guards and wheel attachment elements are made in one piece with the ski body.

A brake in accordance with this embodiment is particularly suitable when the roller ski according to the invention is made in one piece, and particularly when it is fibre-laminated. This is because, from the point of view of strength, the construction allows the ski to be dimensioned so that repeated substantial downward flexing can be permitted without risk of the ski breaking.

Substantially increased stability is obtained thanks to this integrated construction with the wheel attachment elements and wheel guards constituting direct extensions of the ski body. Special construction elements to secure these components are eliminated. Since, also, the wheel attachment elements and wheel guards are connected to each other, a boxlike housing is formed around the wheels. The wheel guards thus contribute greatly to aligning the attachment of the wheel. Altogether this produces greatly increased stability during skiing.

In accordance with a preferred embodiment of the invention the integrated piece is made of a composite material. The use of composite material allows the properties of different materials to be combined in a way that optimises the possibility of achieving both high strength and low weight.

In the embodiment using composite material a preferred material is fibres. Composite material comprising fibres allows optimisation of the strength properties depending on the direction of the various types of loading. In a roller ski the dominant type of loading is repeated dynamic flexural stress in the vertical plane. For such stress a fibre direction in the longitudinal direction of the ski is most beneficial. This further increases the prospects for minimising the weight of the ski while still retaining the strength requirements. Other types of stress may dominate at certain points on the ski and the direction of the fibres can be optimised there with regard to these stresses.

In accordance with yet another preferred embodiment of the invention the fibre material is glass, carbon or KEVLAR®. The base material is a polymer. These fibre materials are strong and have particularly good properties as regards absorbing repeated loading. The polymer material results in low weight with retained ability to utilise the strength properties of the fibres.

In accordance with another preferred embodiment of the ski provided with brake, a setting device is arranged for setting the activation level of the brake activator. This enables individual adjustment of the roller ski to the user's weight and/or how strong a skier he/she is. This arrangement is similar to choosing an individually adjusted span for a ski intended for snow and also how the grip can be varied by varying the length of the area on which gripping wax is applied.

In accordance with yet another preferred embodiment the wheel brake is a wheel locking arrangement. Wheel braking can thus be realised in a simple manner by utilising the principle for a conventional ratchet wheel.

The preferred embodiments of the roller ski in accordance with the invention described above, as well as other preferred embodiments are are described in detail bellow.

The invention is described more closely in the following detailed description of a preferred embodiment thereof, with reference to the accompanying drawings.

DETAILED DESCRIPTION OF AN ADVANTAGEOUS EMBODIMENT OF THE INVENTION

Figure 1:
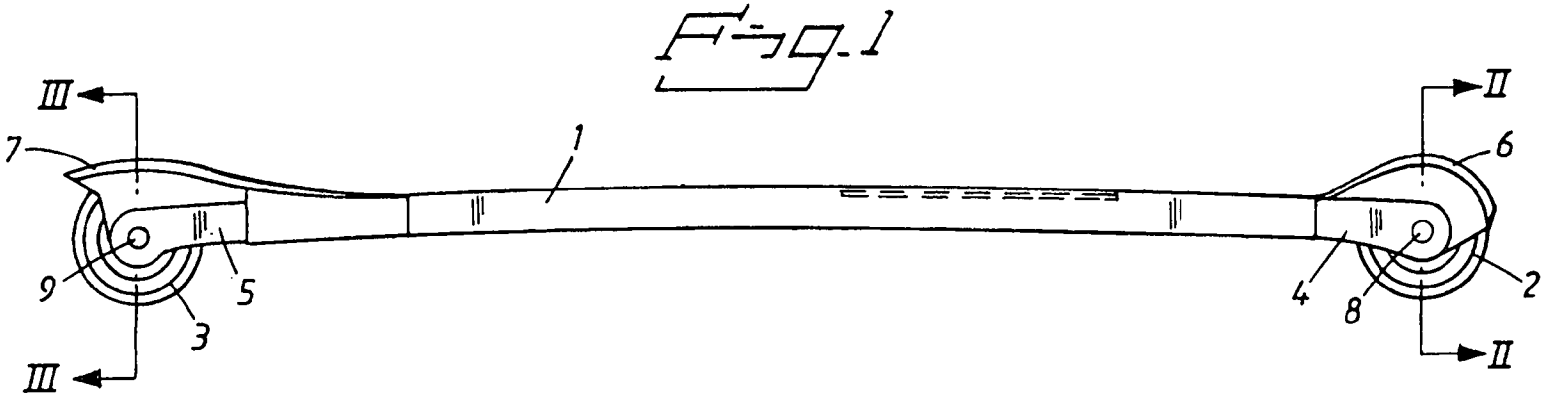
FIG. 1 is a side view of a ski in accordance with the invention.

FIG. 1 shows a side view of an example of a roller ski in accordance with the invention. The roller ski comprises a ski body 1 to which a front wheel 2 and a rear wheel 3 are attached. The rear wheel 2 is attached to the ski body 1 by means of wheel attachment elements 4. The wheel attachment elements 4 consist of an extension part of each end of the ski body and are made in one piece with this. A hole is arranged in each wheel attachment element 4, in which the axle 8 of the wheel 2 is arranged. The wheel 2 is journalled on the axle 8 by means of bearings 10. Above the wheel 2 is a wheel guard 6, this also being made in one piece with the ski body 1. Each side edge of the wheel guard 6 is joined to the upper edge of the wheel attachment element 4 on the appropriate side. Thus the wheel guard 6 and the two wheel attachment elements 4 together form a boxlike housing that surrounds the wheel 2 at the top and sides.

Figure 2:
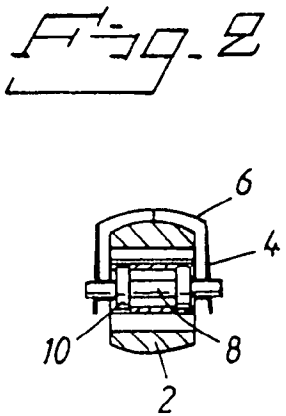
FIG. 2 is a section along the line II—II in FIG. 1.

FIG. 2, which is a section along the line II—II in FIG. 1, illustrates more clearly how the wheel 2, via the bearing 10 and axle 8, is attached to the wheel attachment elements 4 and how these are joined to the wheel guard 6 to form said housing.

Figure 3:
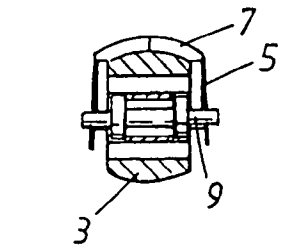
FIG. 3 is a section along the line III in FIG. 1.

The front wheel 3 is provided in similar manner with wheel guard 7 and attachments elements 5. FIG. 3 shows the front wheel in a section along the line III—III in FIG. 1.

As is clear from FIG. 1 the wheel guards 6 and 7 are slightly different. The front wheel guard 7 extends somewhat further than the rear guard 6. Furthermore, the rear wheel guard 6 surrounds a larger part of the circumference of the wheel than the front guard 7 does.

Figure 4:
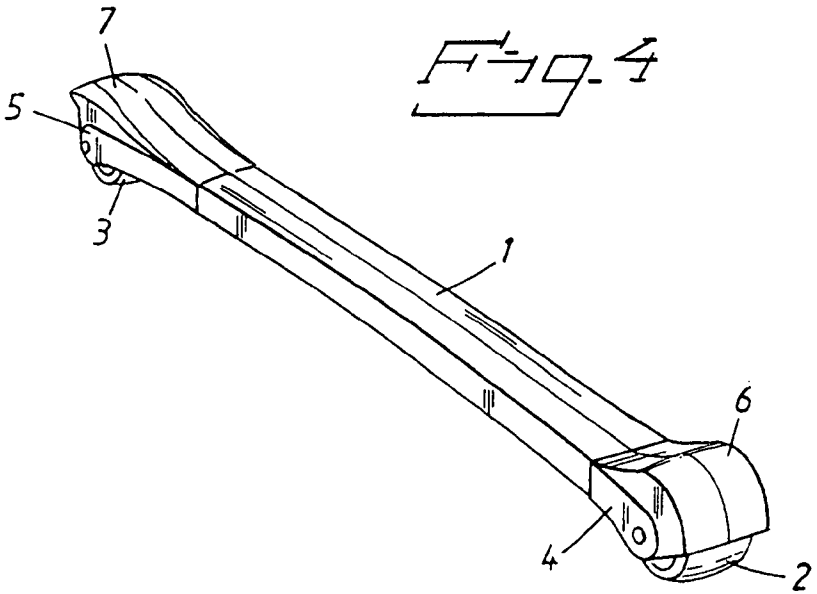
FIG. 4 is a perspective view of a roller ski as shown in FIGS. 1–3.

FIG. 4 illustrates the roller ski shown in FIGS. 1–3, seen in perspective.

Figure 5:
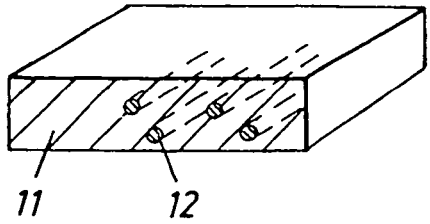
FIG. 5 is an enlargement of a section cut from the material of the ski body.

A piece cut out of a part of the ski body 1 is shown in FIG. 5. The base material 11 is a polymer, reinforced with fibres 12. The fibres are of glass, carbon or Kevlar and are shown in this part of the ski body as arranged parallel in the longitudinal direction of the ski. However, the fibre direction may vary in different parts of the ski body 1, wheel attachment elements 4, 5 and wheel guards 6, 7, in order to optimise the strength depending on the various flexural, torsional and shearing stresses that may appear locally in the ski. The fibre length may also vary and be optimised depending on these stresses.

Figure 6:
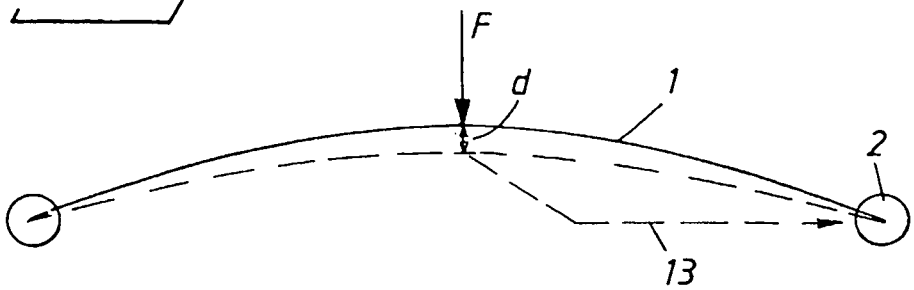
FIG. 6 illustrates the principle for braking the ski shown in FIGS. 1–5.

FIG. 6 illustrates the principle of how the brake for the roller ski is activated. This occurs at a certain depression d of the ski body 1 from its unloaded position. In unloaded position the ski body is curved gently upwards. The depression is due to the load F on the ski body from the skier. A brake activating system 13 built into the roller ski initiates activation of the brake so that the rear wheel of the roller ski is prevented from rotating. The magnitude of the depression d when the brake shall be activated is from 3 to 15 mm and can be adjusted for different skiers.

Figure 7:
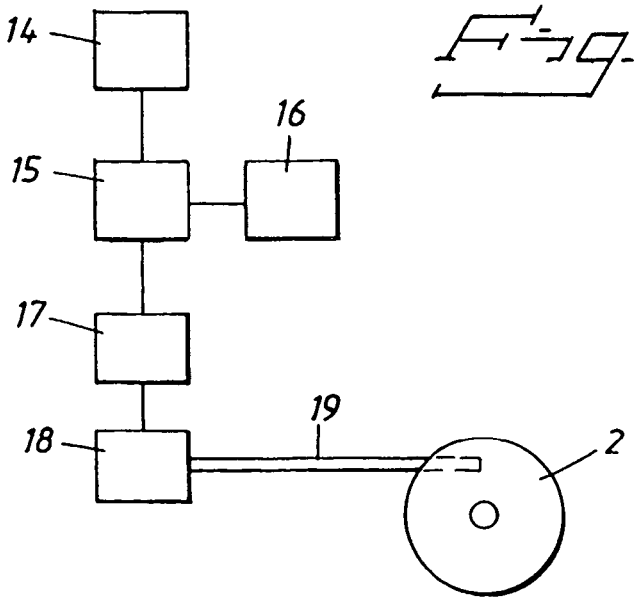
FIG. 7 is a block diagram illustrating a first embodiment of the braking system for the ski.

FIG. 7 shows a block diagram in a first embodiment of the brake activating system 13. The depression of the ski body 1 is measured by a wire strain gauge 14. When a certain value measured by the wire strain gauge, corresponding to a certain depression d, is exceeded an electric current is connected to drive an activator 18. The current supply is obtained from a battery 16 and the current is amplified by an electronic amplifier 17. The value shown by the wire strain gauge 14, at which the current shall be connected is set by means of a setting device 15. The activator 18 is an electric coil arranged to displace a draw bar 19 in the longitudinal direction of the roller ski. The other end of the draw bar 19 is arranged to influence a ratchet mechanism of the wheel 2 so that this is retarded.

Figure 8:
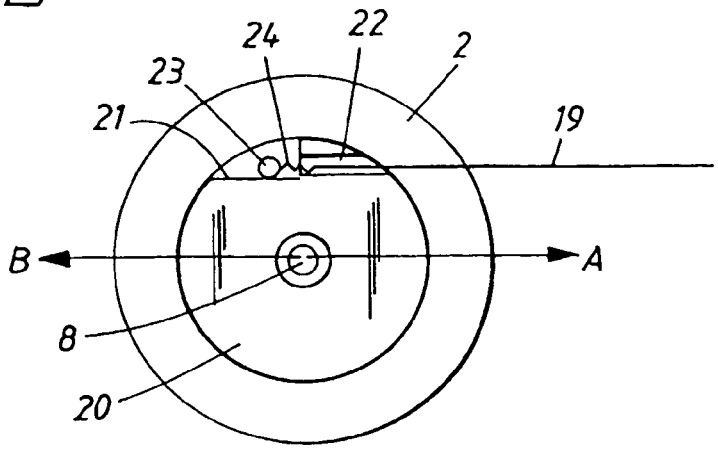
FIG. 8 illustrates the function of an embodiment of a wheel brake on the ski in off position.
Figure 9:
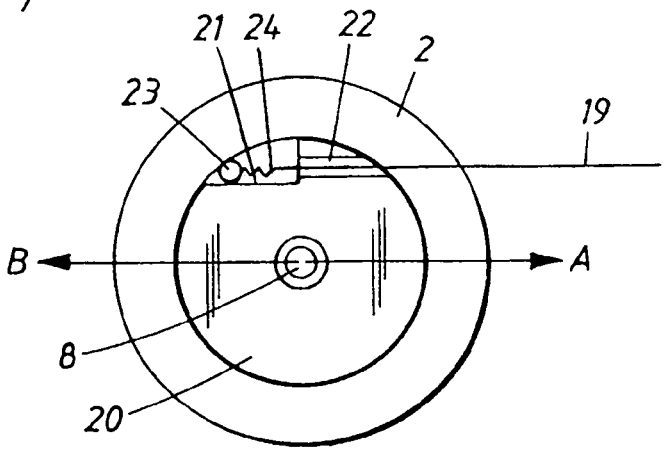
FIG. 9 illustrates the function of the wheel brake in braking position.

FIGS. 8 and 9 illustrate an embodiment of the ratchet mechanism for the brake. The wheel 2 is journalled so that it rotates freely about the axle 8. A stationary disc 20 is joined to the axle 8 so that it is unable to turn on its own. The disc 20 is provided with a recess 21 at its periphery. A boring 22 extends from one wall of the recess, through the disc and out to its periphery. The draw bar 19 extends through the boring 22 and into the recess 21. A lock roller is attached via a spiral spring 24 to the end of the draw bar. FIG. 8 shows the wheel in off position, in which position the lock roller in the recess 21 is not in contact with the wheel 2. In this position the wheel can rotate in both directions, thus allowing movement both forwards A and backwards B.

In FIG. 9 the brake activator has displaced the rod to the left in the figure so that the lock roller 23 is in contact with the inside of the wheel 2. The displacement is in the order of 1–3 mm. Rotation of the wheel 2 in counter-clockwise direction is prevented by the wedge effect that arises when the lock roller 23 is clamped between the inside of the wheel and one wall of the recess 21. The wheel is thus prevented from movement backwards, direction B.

Rotation of the wheel in clockwise direction is not prevented by the lock roller 23. Movement forwards, direction A, is thus not prevented.

Figure 10:
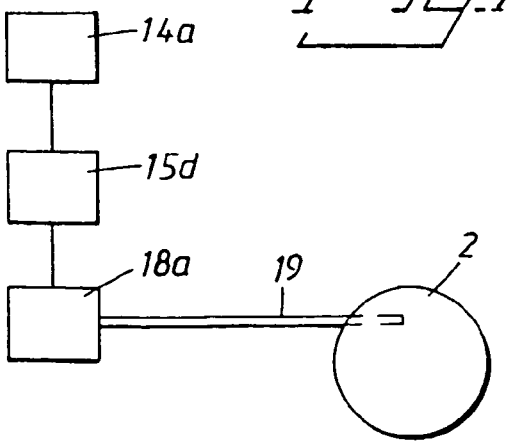
FIG. 10 is a block diagram illustrating a second embodiment of the braking system for the ski.

A second embodiment of the brake activating system 13 is illustrated in FIG. 10. In this example the brake is activated purely mechanically. A mechanical transducer 14*a* senses directly physically the magnitude of the depression by means of co-operating rods. If a certain value of depression is exceeded, the movement is transmitted to an activator 18*a*. The activator is a mechanism constructed in suitable manner from cooperating rods and possibly wires. With a suitably balanced gear exchange of the activator 18*a* the depression movement is converted to a displacement movement of the draw bar 19. This activates braking of the rear wheel 2 in similar manner to in the example according to FIG. 7. The value of the depression at which the transducer 14*a* shall connect the activator 18*a* to displace the draw bar 19 is set by means of a mechanical setting device 15*a*.

What is claimed is:

1. A roller ski comprising:

a ski body having a front and a rear end;

a wheel located at each end;

a wheel brake; and an electric brake activator operative to activate the wheel brake when a preset downward flexing of the ski body in the region between the rear and the front wheel is exceeded; and a wire strain gauge arranged to measure the downward flexing of the roller ski.

2. A roller ski comprising:

a ski body having a front and a rear end;

a wheel located at each end;

a wheel brake; and an electric brake activator operative to activate the wheel brake when a preset downward flexing of the ski body in the region between the rear and the front wheel is exceeded, wherein the brake activator comprises an electric coil and a draw bar arranged to influence a ratchet mechanism in one of the wheels.

3. A roller ski as claimed in claim 2, further including a setting device for setting an activation level of the brake activator.

4. A roller ski as claimed in claim 2, wherein the wheel brake is operative to look a wheel with which it is associated.

5. A roller ski as claimed in claim 2, wherein the roller ski comprises an electric battery and an electronic amplifier.

6. A roller ski as claimed in claim 2, further including a wire strain gauge arranged to measure the downward flexing of the roller ski.

7. A roller ski as claimed in claim 2, wherein the brake is operative to engage and lock one of the wheels when the preset downward flexing of the ski in the region between the rear and the front wheel is exceeded, and is otherwise disengaged from said wheel.

8. A roller ski as claimed in claim 7, wherein the wheel is locked in only one direction when the brake is operative.

9. A roller ski as claimed in claim 2, further including front and rear wheel housings, each including a wheel attachment element and a wheel guard, wherein the wheel attachment element and the wheel guard of at least one of the wheel housings are formed integrally with the ski body and joined together to form the wheel housing.

10. A roller ski as claimed in claim 9, wherein the body and the wheel housings are made of a composite material.

11. A roller ski as claimed in claim 10, wherein the composite material comprises fibres.

12. A roller ski as claimed in claim 10, wherein the composite material comprises fibres of glass, carbon or KEVLAR® enclosed in a polymer material.

* * * * *